US005257949A

United States Patent [19]

Paulus

[11] Patent Number: 5,257,949

[45] Date of Patent: Nov. 2, 1993

[54] CONNECTOR WITH INTERCHANGEABLE CONTACTS

[75] Inventor: Eric J. Paulus, Scottsdale, Ariz.

[73] Assignee: ITT Corporation, Secaucus, N.J.

[21] Appl. No.: 828,791

[22] PCT Filed: Oct. 17, 1993

[86] PCT No.: PCT/US91/07659

§ 371 Date: Jan. 22, 1992

§ 102(e) Date: Jan. 22, 1992

[51] Int. Cl.[5] ..... H01R 13/66

[52] U.S. Cl. ..... 439/620; 439/608; 439/750; 333/185

[58] Field of Search ..... 439/608, 620, 750; 333/181-185

[56] References Cited

U.S. PATENT DOCUMENTS

| | | | |
|---|---|---|---|
| 3,569,915 | 3/1971 | Sorensen | 439/608 |
| 3,710,285 | 1/1973 | Schor et al. | 333/79 |
| 3,721,869 | 3/1973 | Paoli | 439/608 |
| 3,790,858 | 2/1974 | Brancaleone et al. | 439/95 |
| 3,825,874 | 7/1974 | Peverill | 439/608 |
| 4,083,022 | 4/1978 | Nijman | 333/79 |
| 4,126,370 | 11/1978 | Nijman | 439/620 |
| 4,260,966 | 4/1981 | Boutros | 333/182 |
| 4,275,945 | 6/1981 | Krantz et al. | 439/620 |
| 4,276,523 | 6/1981 | Boutros et al. | 333/182 |
| 4,296,390 | 10/1981 | Vanderheyden et al. | 333/182 |
| 4,329,665 | 5/1982 | Kawai et al. | 333/182 |
| 4,362,350 | 12/1982 | von Harz | 439/608 |
| 4,401,355 | 8/1983 | Young | 439/620 |
| 4,458,220 | 7/1984 | Carter et al. | 333/182 |
| 4,494,092 | 1/1985 | Griffen | 333/182 |
| 4,500,159 | 2/1985 | Briones et al. | 439/620 |
| 4,516,815 | 5/1985 | Venable et al. | 439/620 |
| 4,519,665 | 5/1985 | Althouse et al. | 439/608 |
| 4,572,600 | 2/1986 | Nieman | 439/620 |
| 4,600,262 | 7/1986 | Nieman et al. | 439/620 |
| 4,695,115 | 9/1987 | Talend | 439/76 |
| 4,746,310 | 5/1988 | Morse et al. | 439/620 |
| 4,747,789 | 5/1988 | Gliha | 439/620 |
| 4,768,977 | 9/1988 | Gliha, Jr. et al. | 439/620 |
| 4,789,360 | 12/1988 | Paul et al. | 439/620 |
| 4,801,904 | 1/1989 | Sakamoto et al. | 333/182 |
| 4,820,174 | 4/1989 | Farrar et al. | 439/95 |
| 4,853,659 | 8/1989 | Kling | 333/184 |
| 4,922,156 | 5/1990 | Turcotte et al. | 315/244 |
| 4,954,794 | 9/1990 | Nieman et al. | 439/620 |

FOREIGN PATENT DOCUMENTS

| | | | |
|---|---|---|---|
| 2137436 | 10/1984 | United Kingdom | 439/608 |

*Primary Examiner*—Gary F. Paumen
*Attorney, Agent, or Firm*—Thomas L. Peterson

[57] ABSTRACT

A connector is described wherein some contacts include circuit components, and the contacts can be arranged in a custom pattern by the user. A first group of component contacts (e.g. 22A, FIG. 4) each includes at least one circuit component (60) mounted on the middle of a conductive element (52A), with the contact having a cylindrical conductor (64) of predetermined outside diameter D. A second group of passive contacts include a feed through contact (22C, FIG. 6) wherein insulation (80) is disposed about the middle of a conductive element and has about the same outside diameter as the component contacts to enable the contacts to be interchanged. The connector include a ground plane (40, FIG. 3) with holes through which each contact passes, and with fingers at the holes for engaging the outside of each contact. The ground plane can be part of a holder (14, FIG. 3) which includes forward and rearward insulators (90, 92) with one having tabs that project through slots in the ground plane and in the other insulator. An assembly can include two substantially identical connectors (132, 134, FIG. 9) in tandem, with the contacts of each connector connected in tandem with the contacts of the other connector, to provide more complicated and custom designed contact circuitry.

7 Claims, 6 Drawing Sheets

CONNECTOR WITH INTERCHANGEABLE CONTACTS

BACKGROUND OF THE INVENTION

Connectors designed for avionics, military, and other high performance applications, have recently included contacts with circuit components. For example, contacts have been used which include Zener diodes or metal oxide varistors (MOV'S) for dissipating to ground, high energy pulses that may be induced on the contact. Other contacts have been designed with filters such as pi filters (an inductor between two capacitors) that block signals above a predetermined frequency such as high frequency noise. Although a connector user can specify to the manufacturer the particular type of connector he requires, specifying which type of component contacts lie at particular locations, this makes it difficult for the user to try different configurations and requires the manufacture to custom make each different type of connector. If the customer, or user, could easily produce his own connector from supplied parts, this could reduce the manufacturing costs and increase the ability of the user to modify his own connector.

Ground planes currently used in connectors to ground some of the contacts, can include a thin plating on an insulator or a sheet metal ground plane. The plated ground plane cannot carry high current surges and the plating cost is considerable. Current sheet metal ground planes are bonded to insulators to assure that the spring fingers at the outer edge of the ground plane will lie stably within a connector shell. The cost of bonding the sheet metal ground plane to an insulator adds to the cost of the connector. A ground plane and insulator assembly which could be constructed at low cost would be of value.

SUMMARY OF THE INVENTION

In accordance with one embodiment of the present invention, a connector is provided of the type that has at least one component contact which includes a component mounted on a conductive element, which is versatile and of low cost. The connector is of the type that includes a ground plane with contact-passing apertures through which a contact can be inserted so a middle portion of the contact is connected to the ground plane. A first group of contacts comprise component contacts, each including a circuit component mounted on the middle of the conductive element and a cylindrical conductor of a diameter to engage ground plane fingers in the ground plane aperture. A second group of contacts comprise feed through contacts, each including insulation surrounding the middle of the element, with the insulation having a largely cylindrical exterior of a diameter great enough to engage fingers of the ground plane. A third group of contacts comprises ground contacts, each including an enlarged conductive element middle diameter great enough to engage fingers of the ground plane. The feed through and ground contacts are interchangeable with the component contacts.

The ground plane is stamped or otherwise formed of a sheet of metal and has slots. Forward and rearward insulators lie facewise against opposite faces of the ground plane, with one insulator having tabs that project through the slots in the ground plane and into slots in the other insulator where the tabs are tightly captured to hold the assembly together.

A pair of connectors with interchangeable contact can be connected in tandem, with each contact of one connector lying in tandem with a contact of the other connector. This enables each pair of tandem contacts to provide a more complicated circuit, as where one provides a diode for dissipating most of the energy of a pulse, and the other provides a filter for further dissipating the pulse energy at certain frequencies.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
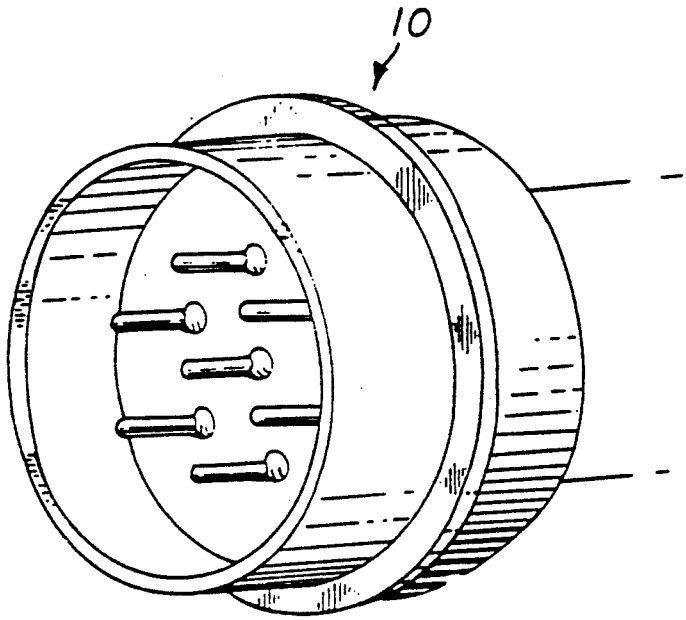
FIG. 1 is a front isometric view of a connector constructed in accordance with the present invention.
Figure 2:
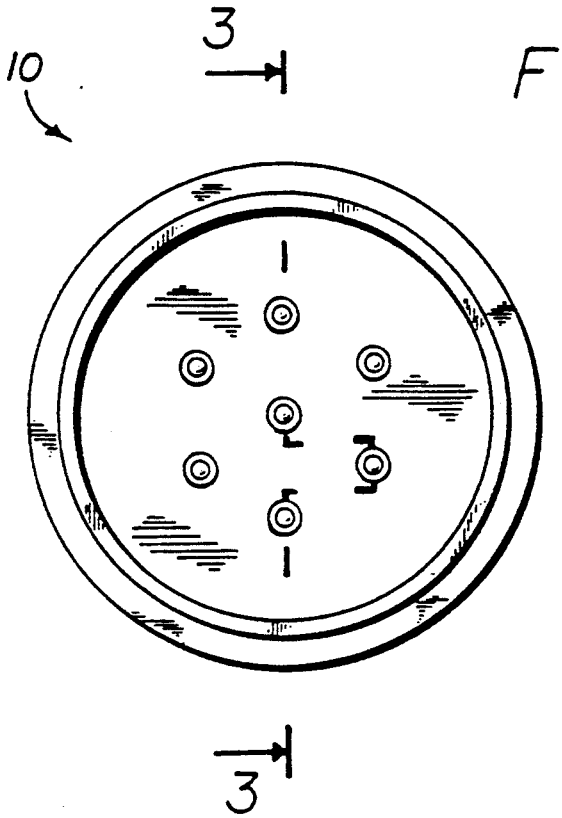
FIG. 2 is a front elevation view of the connector of FIG. 1.
Figure 3:
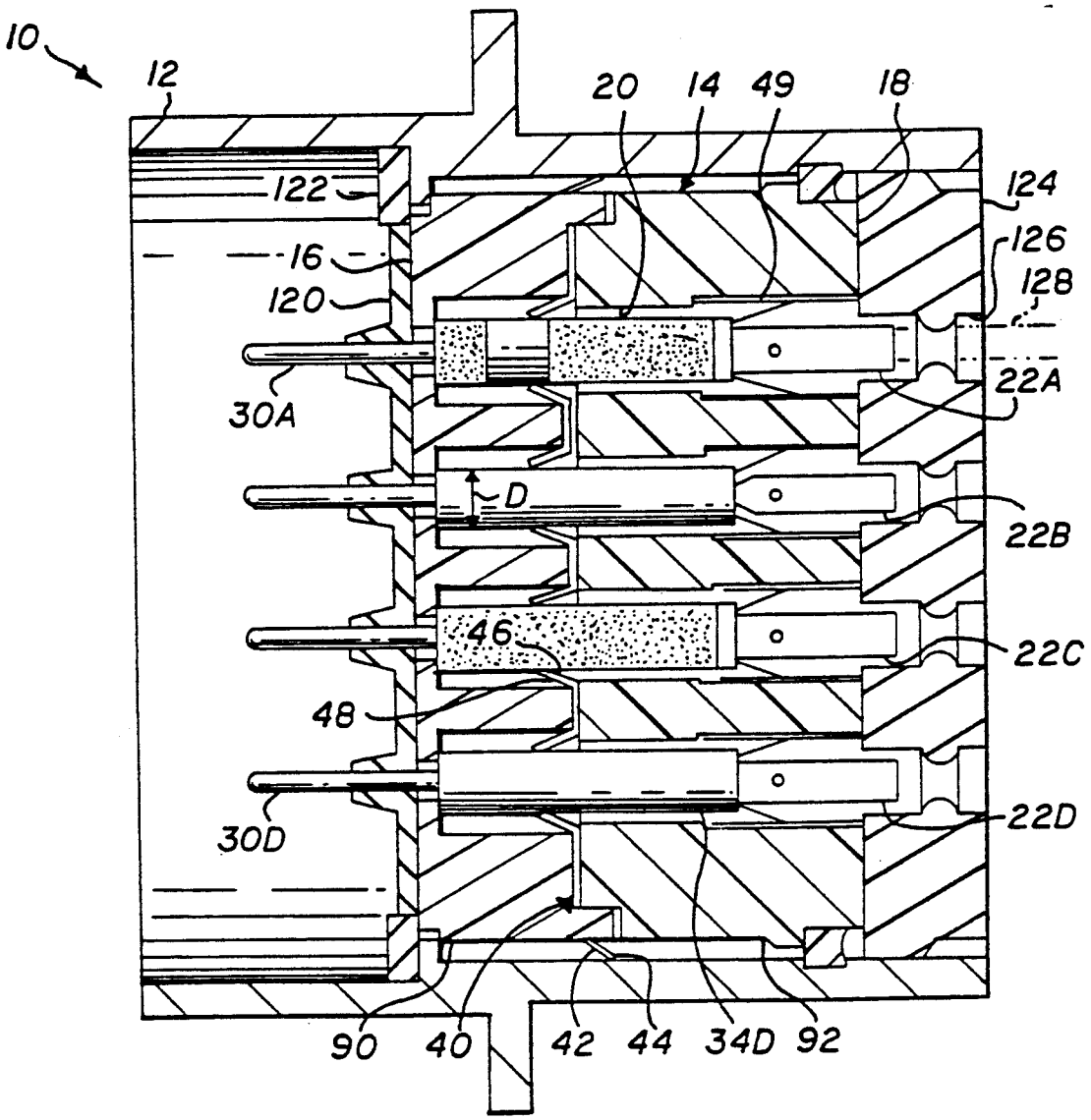
FIG. 3 is a view taken on the line 3—3 of FIG. 2.

FIG. 3 illustrates a connector 10 which includes a conductive shell 12 and a holder 14 lying within the shell. The holder has forward and rearward ends 16, 18 and a plurality of contact-receiving holes 20. A plurality of contacts 22A–22D lie in each of the holes, with each contact having forward and rearward ends 30A–30D and 32A–32D. Each contact has a middle portion such as 34D lying between the opposite ends of the contact.

The holder 14 includes a conductive ground plane 40 extending across the inside of the shell 12, and having a radially outer edge portion 42 forming multiple tangs 44 that engage the inside of the shell, so the shell and ground plane are at the same potential (usually ground potential). The ground plane has a plurality of apertures 46 lying at the contact-receiving holes 20 of the holder, and has a plurality of projecting fingers 48 at each aperture. The projecting fingers extend into the aperture, and engage the middle portions 34A–34D of the contacts. The fingers are designed to engage contacts whose middle portions have an outside diameter D within a predetermined range of diameters. The middle portions of all of the contacts preferably have an outside diameter within this range.

Each of the contacts is installable in any of the plurality of contact-receiving holes. Each of the contacts can be removed and installed in the hole previously occupied by another contact, so the contacts are interchangeably installable in any of the holes. Rear release retainers 49 hold each contact in place.

FIGS. 4–7 illustrate details of each of the four contacts 22A–22D. All of the contacts include a conductive element 52A–52D extending along the entire length of the contact. The forward ends 30A–30D and rearward ends 32A–32D of each of the conductive elements and contacts are preferably the same, but the element middles 54A–54D may be different for different contacts.

Figure 4:
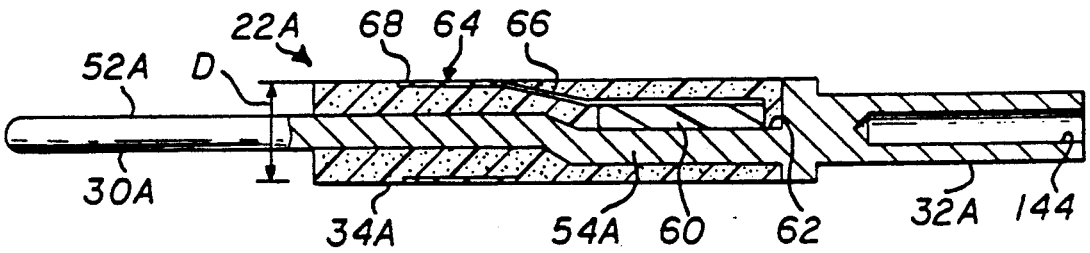
FIG. 4 is a sectional view of the diode contact of FIG. 3.

FIG. 4 illustrates a diode contact 22A which includes a Zener diode 60 mounted on a platform 62 formed in the element middle 54A, with one terminal of the diode mechanically and electrically connected to the platform 62. The contact also includes a ground clip 64 with an outer part 68 lying at the outside of the contact middle portion 34A on a diameter D. The clip 64 has an arm 66 that extends inwardly to a terminal of the diode 60 that is opposite the contact element platform 62. A quantity of molded insulation 69 surrounds the element middle 54A of the conductive element 52A. The purpose of the insulation is to protect the diode 60 from mechanical damage and to form a cylinder with diameter D. When a high voltage pulse travels along the contact, the Zener diode breaks down and allows most of the energy of the pulse to pass through the ground clip 64 and through the ground plane engaged therewith to ground. This type of diode contact 22A has been sold by applicant for several years.

Figure 5:
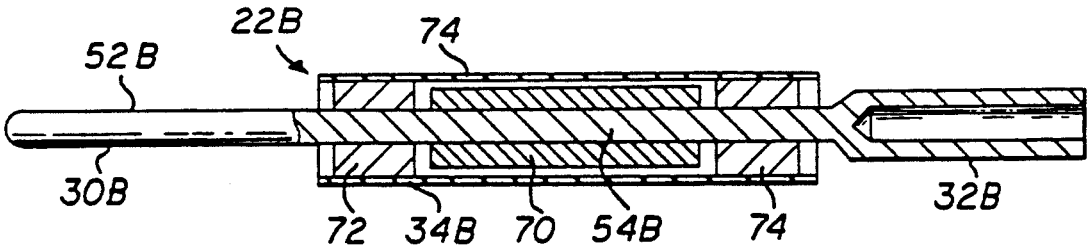
FIG. 5 is a sectional view of the filter contact of FIG. 3.

FIG. 5 illustrates the filter contact 22B. It includes a ferrite bead 70 surrounding the element middle 54B of the conductive element 52B, and a pair of capacitors 72, 74 surrounding the element middle and lying at opposite ends of the ferrite bead. A conductive cylinder 74 surrounds the ferrite and capacitor circuit components. Each capacitor has an inner terminal electrically connected to the conductive element middle and the outer terminal connected to the conductive cylinder 74. Applicant prefers to use discoidal capacitors, which have conductive plates extending perpendicular to the length of the conductive element. It may be noted that the ferrite bead 70 does not have to be electrically connected to anything, and preferably does not touch the conductive cylinder 74 to avoid a moderate resistance direct connection of the conductive element and conductive cylinder through the ferrite bead. It may be noted that both the diode contact 22A and filter contact 22B may be considered to be component contacts in that each includes a circuit component. A circuit component is a device such as a diode, capacitor, inductor, varistor or resistor that affects changing currents passing therethrough, other than merely always conducting or always not conducting them. The circuit component can be any shape such as a chip diode or a tubular varistor.

Figure 10:
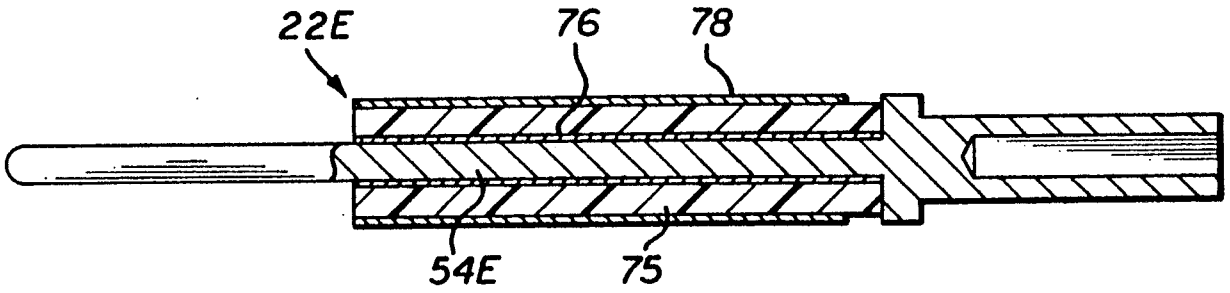
FIG. 10 is a sectional view of a varistor contact which can be installed in the connector of FIG. 3.

FIG. 10 illustrates a varistor contact 22E which can sometimes be used instead of the diode contact of FIG. 4 to dissipate high energy pulses. The varistor contact 22E includes a circuit component formed by a varistor 75 mounted on an element middle 54E. The tubular varistor has been metalized, so it has metal layers 76, 78 at its inner and outer diameters. The inner layer 76 contacts the element middle 54E while the outer layer 78 contacts fingers of the ground plane when the varistor contact is installed in the connector.

Figure 6:
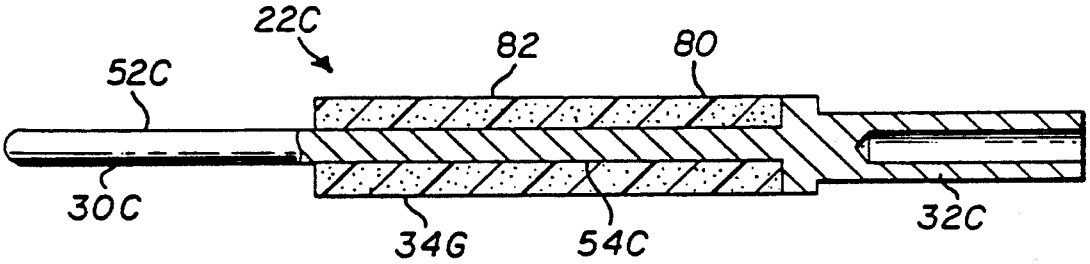
FIG. 6 is a sectional view of the feed through contact of FIG. 3.

FIG. 6 illustrates the feed through contact 22C which includes a quantity of insulation 80 surrounding the element middle 54C of the conductive element 52C. The radially outer surface 82 of the insulation is substantially cylindrical, and has about the same diameter as the outside diameters of the ground clip 64 and conductive cylinder 74 of the contacts of FIGS. 4 and 5. The purpose of the insulation 80 is to isolate the conductive element 52C from the fingers of the ground plane to avoid contact with the ground plane. The outer diameter of the insulation 80 is preferably large enough to engage the fingers of the ground plane that extended to the aperture through which the feed through contact extends. This enables the fingers of the ground plane to stabilize the position of the middle of the feed through contact and prevent it from "rattling". In addition, this allows a mold used to mold insulation at the middle portion 34A of the diode contact, to be used to mold the insulation at the middle portion 34C of the feed through contact.

Figure 7:
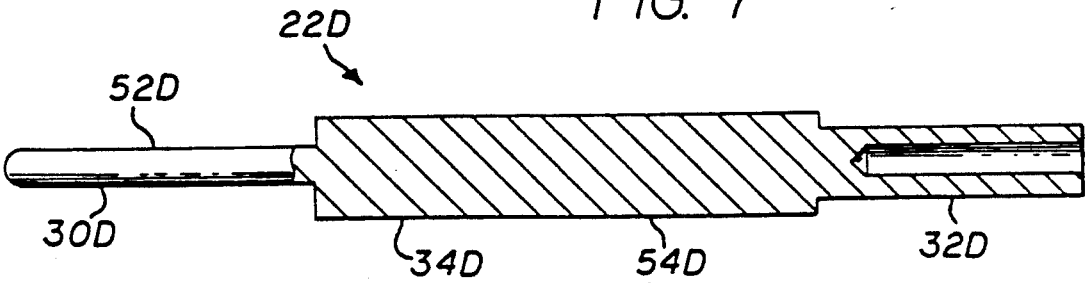
FIG. 7 is a sectional view of the ground contact of FIG. 3.

FIG. 7 illustrates details of the ground contact 22D. The middle portion 34D of the ground contact is formed by an enlarged element middle 54D of the conductive element 52D. The ground contact can be used to connect the ground plane and thereby the shell of the connector, to ground, in cases where there is not another grounding system to connect to the shell of the connector. The middle portions of all of the contact 22A–22D preferably have approximately the same outside diameter D.

Figure 8:
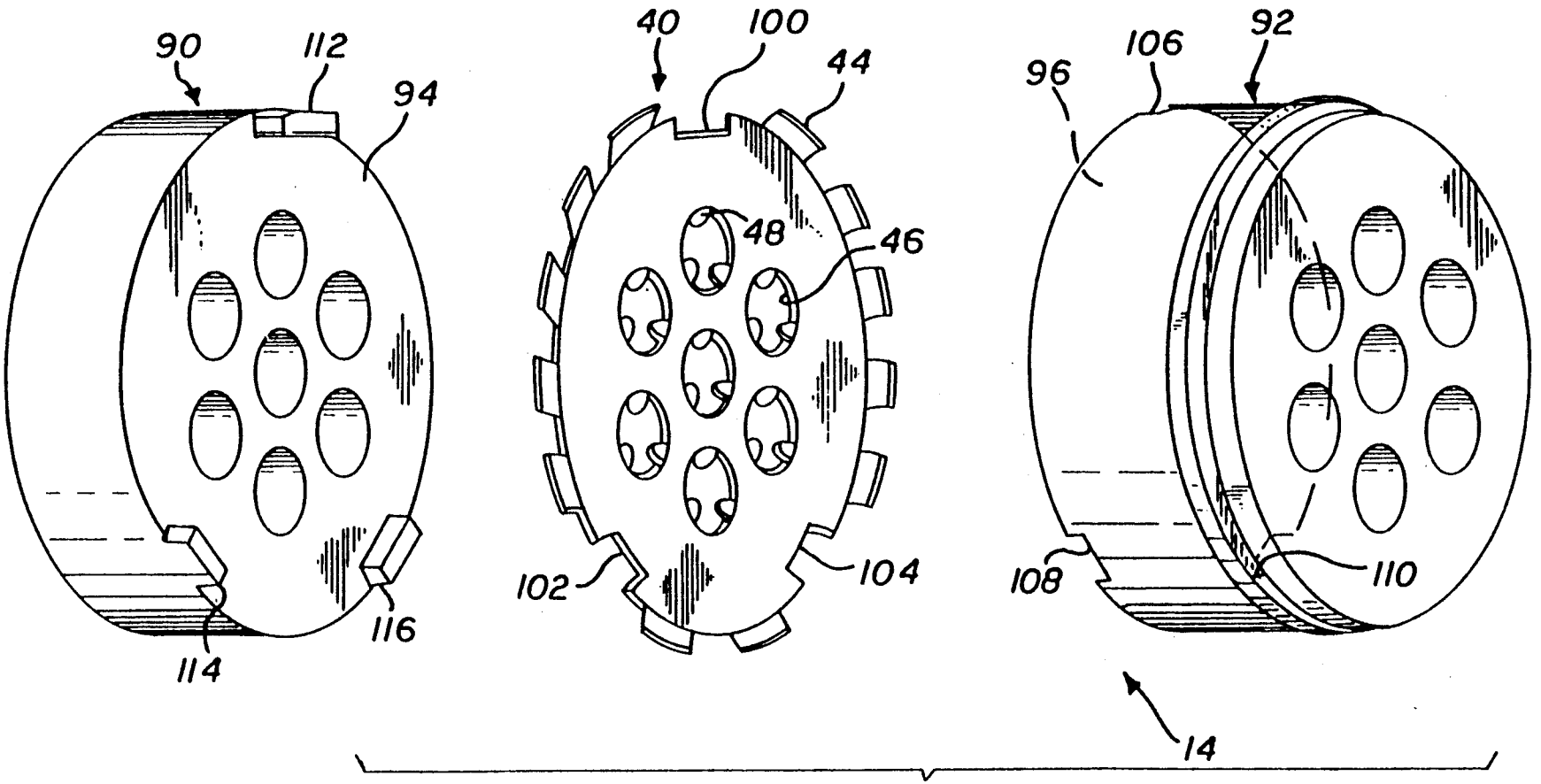
FIG. 8 is an exploded isometric view of the holder of FIG. 3.

FIG. 8 illustrates details of the holder 14 which holds the contacts in place. The holder includes forward and rearward insulators 90, 92 having inner surfaces 94, 96 facing each other. The ground plane 40 is a conductive sheet, formed of sheet metal that has been stamped, formed, heat treated and gold plated prior to assembly. The ground plane 40 is sandwiched between the inner surfaces 94, 96 of the insulators. The ground plane is formed with a plurality of slots 100–104. The rear insulator 92 also has a plurality of slots 106–110 aligned with the slots in the ground plane. The forward insulator 90 has a plurality of tabs 112–116 that project through the slots in the ground plane 90 and into the slots in the rearward insulator 92. The tabs 112–116 are captured in the rearward insulator slots 106–110, as by heat welding them in place, providing for an interference fit of the tabs in the slots, or providing latches. When the holder 14 is assembled, it can be inserted as a unit into the shell, with the ground plane 40 stabilized in position to assure that as its fingers 44 press against the inside of the shell, the ground plane will extend perpendicular to the shell.

Referring again to FIG. 3, it can be seen that the connector includes an interfacial seal 120 at the front of the holder for sealing around the front ends 30A–30D of the contacts, and includes a peripheral seal 122 around the interfacial seal. A grommet 124 lies at the rear of the holder and has multiple openings 126 that can pass wires 128 that connect to the rearward ends of the contacts. The particular contacts shown have cylindrical bores 144 (FIG. 4) in their rearward end, that can be used to receive the conductors of wire and which can be crimped to the conductors.

Figure 9:
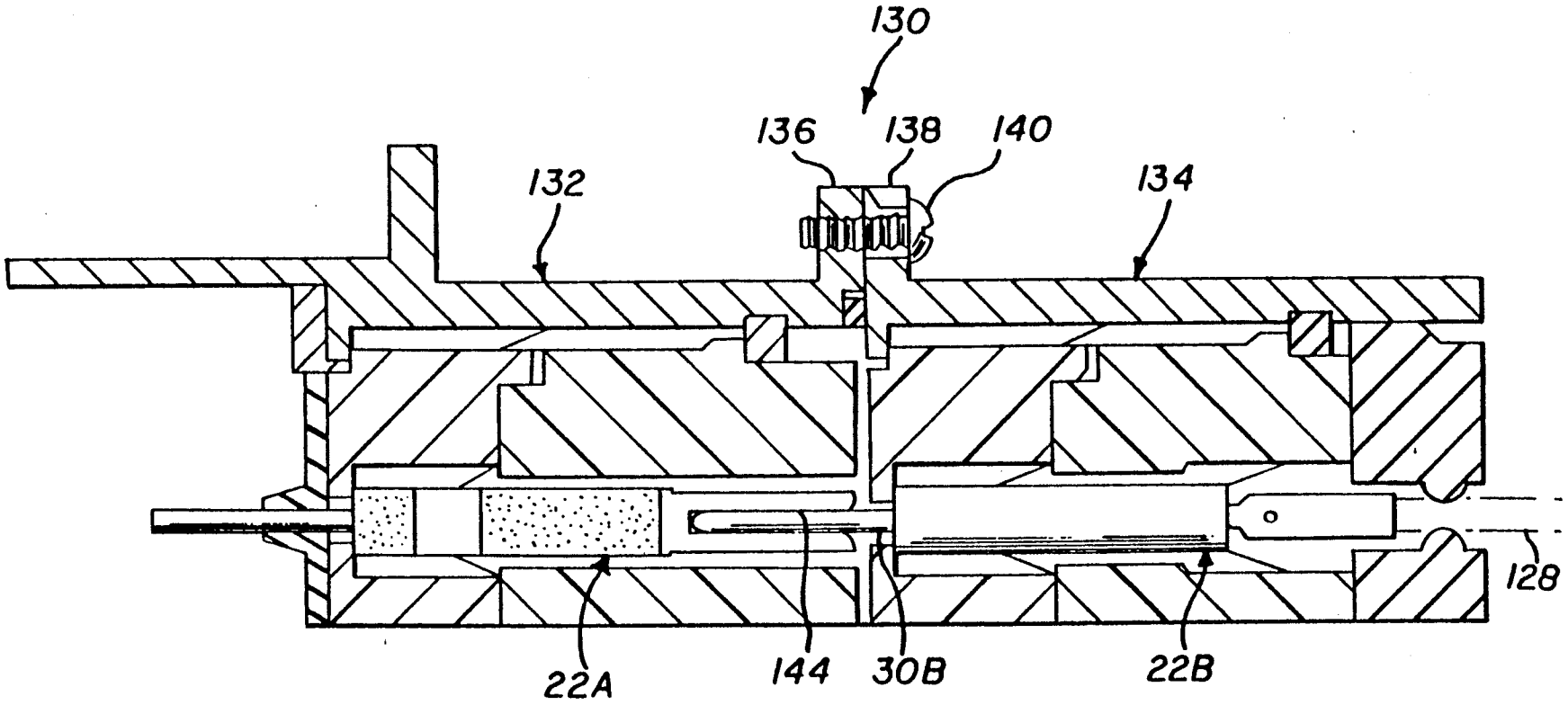
FIG. 9 is a partial sectional view of a connector arrangement constructed in accordance with another embodiment of the invention.

FIG. 9 illustrates a connector assembly 130 which includes two connectors 132, 134 connected in tandem, with each connector being similar to the connector of FIG. 3. The second connector 134 and its parts may be referred to as "devices" to distinguish them from the first connector 132 and its parts. The connectors have adjacent flanges 136, 138 with holes for receiving screws 140 that hold the shells together. A first contact 22A in the first or forward connector 132 is a diode contact which has the construction shown in FIG. 4. However, the cylindrical bore 144X has been slotted to form fingers that have been deformed to converge slightly and form a socket, so as to receive and engage the pin-like forward end such as 30B of another contact. A first contact 22B in the second or rearward connector 134 is a filter contact having the construction of the contact shown in FIG. 5. The forward end 30B of the filter contact engages the socket in the diode contact 22A. Thus the connected contacts 22A, 22B provide both a Zener diode for dissipating much of the power of a high voltage pulse, while filter contact 22B can further dissipate the pulse at certain frequencies. In another example, the low pass filter at position 22B can be connected in tandem with a high pass filter in the other connector, to thereby produce a band pass filter. The manufacturer supplies the parts of the arrangement and the user can install the contacts, with the tandem arrangement enabling the contacts to provide more complex circuitry and with greater versatility than heretofore.

A variety of other active contacts can be provided, including those with just a capacitor, ferrite bead, resistor, or varistor. This provides considerable versatility in designing a circuit in the connector for modifying currents that may pass through a wire 128 to the connector.

Thus, the invention provides a connector which enables high versatility for the user, at moderate cost. The connector includes a holder within a conductive shell, the holder including a ground plane with finger at each aperture therein for engaging contacts. A variety of contacts are provided, including groups of component contacts (each group includes at least one contact) having one or more circuit components, and groups of passive contacts such as a feed through contact having a substantially cylindrical insulator surrounding the conductive element of the contact, with the outside of the insulator being large enough to engage fingers of the ground plane. The holder can include a sheet metal ground plane sandwiched between a pair of insulators, with one of the insulators having tabs projecting through slots in the ground plane and in the other insulator and captured in the other insulator to hold the parts securely together as a unit. A contact arrangement can be used which includes two similar connectors with interchangeable contacts to provide for more complex circuitry along each pair of contacts.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A connector which has a conductive shell, a holder lying in said shell with said holder having forward and rearward ends and a plurality of contact-receiving holes therein, and a plurality of contacts each lying in one of said holes with each contact having forward and rearward ends lying adjacent to corresponding ends of said holder and with each contact having a middle portion, wherein said holder includes a conductive ground plane extending across the inside of said shell and having an outer edge portion electrically grounded to said shell and a plurality of apertures lying at said contact-receiving holes and having projecting fingers extending into said apertures for engaging said contacts with said finger formed to engage a cylindrical portion of predetermined diameter, characterized by:

each of said plurality of contacts is individually removable and replaceable and is interchangeably installable in any of said plurality of contact-receiving holes, and each of said plurality of contacts includes a conductive element extending along the entire length of the contact and having an element middle;

a first group of said contacts including component contacts with each including a circuit component mounted on said element middle and a substantially cylindrical conductor of said predetermined diameter extending about said element middle, said component having a first terminal connected to said element middle and a second terminal connected to said cylindrical conductor;

a second group of said contacts including a feed through contact having only insulation surrounding the element middle.

2. The connector described in claim 1 wherein:

said insulation on said feed through contact middle has a substantially cylindrical exterior which is of substantially said predetermined diameter.

3. The connector described in claim 1 wherein:

said holder includes front and rear insulators with facing inner ends and said ground plane includes a metal sheet that is sandwiched between said insulators, a first of said insulators having a plurality of tabs extending from the inner end thereof toward the other insulator, and the second of said insulators having a plurality of slots extending into the inner end thereof and which are constructed to receive and capture said tabs, said ground plane having a plurality of slots that receive said tabs.

4. The connector described in claim 1 including:

a second connector device having a second conductive shell device, a second holder device lying in said second shell device with forward and rearward ends and a plurality of contact-receiving holes therein, and a plurality of second contact devices each lying in one of said holes in said second holder device with each second contact device having forward and rearward ends and a middle portion, wherein said second holder device is substantially identical to said holder and includes a second conductive ground plane device with fingers for contacting said second contact device;

said rear ends of said contacts form sockets and said front ends of said second contact devices form pins that can enter and mate with said sockets;

said connector and said second connector device are fastened in tandem, with the pins of said second contact device lying in said sockets of said contacts to connect them in tandem with one of said contacts and one of said contact devices which are connected in tandem each including a circuit component.

5. A connector comprising:

a conductive shell;

a holder lying in said shell, said holder having forward and rearward ends and a plurality of contact-receiving holes therein extending between said ends, said holder including a ground plane having a plurality of apertures at the positions of said holes and having a plurality of fingers projecting into each aperture;

a plurality of contacts which are individually removable and replaceable in said holder holes, said contacts being interchangeably mountable in each of said plurality of holes, with each contact having a conductive element with opposite ends and a middle, said plurality of contacts including at least one component contact and at least one passive contact;

said component contact having a circuit component with a first terminal connected to said element middle and a second terminal, said component contact also having a conductive cylinder lying about said element middle and connected to said second terminal, said conductive cylinder being of a diameter to engage a plurality of said ground plane fingers;

said passive contact is devoid of a circuit component but has a contact middle with an insulative outer diameter large enough to also engage a plurality of said ground plane fingers.

6. A connector assembly comprising:

first and second connectors that are connectable in tandem, each having a shell, a holder lying in the corresponding shell and having a plurality of contact-receiving holes and with said holder having a ground plane with apertures lying at each hole and with a plurality of fingers projecting into each aperture, and a plurality of contacts each mounted in one of said holes;

each of said contacts includes an elongated conductive element with first and second opposite ends forming first and second ends of said contacts and with an element middle lying within one of said ground plane apertures, said contacts of each connector being interchangeably mountable in any of said holes of the holder of that connector;

at least a first contact of each connector including a circuit component with a first terminal mechanically and electrically connected to said element middle, and also including a conductor connected to said second terminal with said conductor having a largely cylindrical outside of a diameter to be engaged by a plurality of fingers of said ground plane;

said connectors being connected in tandem, with said second ends of said contacts of said first connector forming sockets and with said first ends of said contacts of said second connector forming pins received in said sockets of said contacts of said first connector, and with said first contacts of each said first and second connectors being connected in tandem, whereby to enable a more complex circuit to lie along a pair of tandem-connected contacts.

7. The connector described in claim 6 wherein:

said first contact of one of said connectors includes a diode as its component, and said first contact of the other connector includes a plurality of components forming a low pass filter.

* * * * *